US006893303B2

(12) United States Patent
Fuse

(10) Patent No.: US 6,893,303 B2
(45) Date of Patent: May 17, 2005

(54) PERSONAL WATERCRAFT

(75) Inventor: Tomohiro Fuse, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/660,044

(22) Filed: Sep. 10, 2003

(65) Prior Publication Data

US 2004/0127113 A1 Jul. 1, 2004

(30) Foreign Application Priority Data

Sep. 11, 2002 (JP) ..... 2002-266136

(51) Int. Cl.[7] ..... B63H 11/11
(52) U.S. Cl. ..... 440/41; 440/38
(58) Field of Search ..... 440/38, 40, 41, 440/42

(56) References Cited

U.S. PATENT DOCUMENTS 5,879,209 A * 3/1999 Jones ..... 440/42

FOREIGN PATENT DOCUMENTS

JP 2000-198491 7/2000

* cited by examiner

*Primary Examiner*—Jesus D. Sotelo
(74) *Attorney, Agent, or Firm*—Merchant & Gould P.C.

(57) ABSTRACT

A personal watercraft with a steering nozzle for determining the jet direction of jet water is movably disposed on the rear side of a water jet propeller, a connection portion is provided at an upper portion of the steering nozzle, and a reverse bucket has a recessed portion for obviating the interference with the connection portion.

8 Claims, 14 Drawing Sheets

PERSONAL WATERCRAFT

BACKGROUND OF THE INVENTION

1. Field of the Invention

The present invention relates to a personal watercraft in which a steering nozzle for determining the jet direction of jet water is swingable vertically and in the left-right direction and in which a reverse bucket for guiding the jet water forwards is provided.

2. Description of the Related Art

Personal watercraft for use on bodies of water are known. One such example of a personal watercraft is shown in Japanese Patent Laid-open No. 2000-198491 and will be described below.

The personal watercraft comprises an engine and a jet propeller driven by the engine which are provided in a hull, and a steering nozzle provided at the rear end of the jet propeller. The jet propeller is driven by the engine, whereby an impeller of the water jet propeller is rotated, and water is sucked in through an intake port in the hull bottom by the rotation of the impeller.

The water thus sucked in is ejected as jet water from the rear end of the steering nozzle, causing the personal watercraft to plane as a result of the jet force of the jet water.

The steering nozzle of the personal watercraft is swingable in the left-right direction, for steering the hull in the left-right direction during navigation or planing. Furthermore, the steering nozzle is made to be vertically swingable for maintaining the personal watercraft in a favorable posture during navigation.

For vertically swinging the steering nozzle in this manner, an operating cable is connected to an upper end portion of the steering nozzle through a connection portion, the operating cable is extended along an upper portion of the steering nozzle to an operating handle, and the front end of the operating handle is connected to an operating lever.

With this arrangement, the steering nozzle can be vertically swung with the operating cable by operating the operating lever.

Meanwhile, a reverse bucket for moving the personal watercraft rearwards is provided at a rear portion of the steering. The reverse bucket can be disposed at a position for avoiding a jet port of the steering nozzle and at a position opposed to and on the rear side of the jet port. With this arrangement, the reverse bucket can be made to avoid the jet port of the steering nozzle and jet water can thereby be ejected rearwards, such as is the case when the personal watercraft is planing.

On the other hand, when the personal watercraft is moving rearwards, the reverse bucket can be made to front on the jet port of the steering nozzle and the jet water can thereby be guided forwards by the reverse bucket. However, in order to vertically swing the steering nozzle, it is necessary to connect the operating cable to the upper end portion of the steering nozzle through a connection portion.

Therefore, when the reverse bucket is moved to the upper side of the steering nozzle for ensuring that the reverse bucket avoids the jet port of the steering nozzle, the reverse bucket may interfere with the connection portion and the operating cable.

As a method for preventing the interference of the reverse bucket with the connection portion and the operating cable, it may be contemplated to provide the reverse bucket with a cutout in a portion thereof corresponding to the connection portion and the operating cable. However, the reverse bucket has the role of efficiently guiding the jet water forwards and, if the reverse bucket is provided with a cutout, the jet water would pass through the cutout and flow out to the rear side of the reverse bucket.

This makes it difficult to efficiently guide the jet water ejected from the steering nozzle in a forward direction.

Accordingly, it is an object of the present invention to provide a personal watercraft in which jet water can be efficiently guided in a forward direction and in which a reverse bucket can be prevented from interfering with an operating cable and a connection portion for vertical sliding, which are provided at an upper portion of a steering nozzle.

SUMMARY OF THE INVENTION

According to one aspect of the present invention, there is provided a personal watercraft including an engine disposed on the lower side of a deck of a hull, a jet propeller disposed on the rear side of the engine, a steering nozzle for determining the jet direction of jet water, the steering nozzle being movably disposed on the rear side of the jet propeller, an operating cable for vertically moving the steering nozzle, a connection portion of the operating cable being provided at an upper portion of the steering nozzle, and a reverse bucket for guiding the jet water forwards. The reverse bucket is disposed on the rear side of the steering nozzle, and the reverse bucket is provided in its upper portion with a recessed portion for obviating interference with the connection portion.

In another aspect of the present invention a steering system for a personal watercraft is provided with a steering nozzle for determining the direction of jet water ejected from the watercraft, the steering nozzle being movably disposed on a rear side of the jet propeller, an operating cable for vertically moving the steering nozzle; a connection portion of the operating cable being provided at an upper portion of the steering nozzle and connecting the operating cable to the steering nozzle; and a reverse bucket with a recessed portion. The reverse bucket being capable of guiding jet water in a forward direction and being movable between an upper and a lower position. The reverse bucket being disposed on a rear side of the steering nozzle. When the reverse bucket is positioned in the upper position, at least a portion of the connection portion is positioned inside of the recessed portion.

In another aspect of the present invention a personal watercraft is provided with an engine disposed on a lower side of a deck of the watercraft; a jet propeller disposed on a rear side of the engine; a steering nozzle for determining the direction of jet water ejected from the watercraft, the steering nozzle being movably disposed on a rear side of the jet propeller; an operating cable for vertically moving the steering nozzle; a connection portion of the operating cable being provided at an upper portion of the steering nozzle and connecting the operating cable to the steering nozzle; and a reverse bucket with a recessed portion. The reverse bucket is capable of guiding jet water in a forward direction and being movable between an upper and a lower position. The reverse bucket is disposed on a rear side of the steering nozzle. When the reverse bucket is positioned in the upper position, at least a portion of the connection portion is positioned inside of the recessed portion.

In yet another aspect of the present invention a personal watercraft is provided with jet propulsion means; steering means for determining the direction of jet water ejected from the watercraft; operating means for operating the steering means; connection means for connecting the operating means to the steering means; and reverse means for guiding jet water in a forward direction. The reverse means is movable between an upper and a lower position. The reverse bucket includes containing means. When the reverse means is positioned in the upper position, at least a portion of the connection means is positioned within the containing means.

The reverse bucket has been provided in its upper portion with the recessed portion for obviating interference with the connection portion. With this arrangement, it is possible to prevent the reverse bucket from interfering with the connection portion.

In addition, since the reverse bucket is provided with the recessed portion so as to obviate interference with the connection portion, it is unnecessary to provide the reverse bucket with an opening in the rear of the reverse bucket, such as a cutout.

As a result, the jet water ejected from the steering nozzle can be favorably received by the reverse bucket, and, therefore, it is possible to efficiently guide the jet water forwards.

In yet another aspect of the present invention, the connection portion and the connection portion containing recessed portion are disposed on the center in the hull width direction of the steering nozzle. Therefore, the shape of the reverse bucket can be easily made symmetrical on the left and right sides, so that the personal watercraft can be favorably maintained in such a posture as to be stable in the left-right direction.

DETAILED DESCRIPTION OF THE INVENTION

An embodiment of the present invention will be described below based on the accompanying drawings. Here, the terms "front", "rear", "left" and "right" have the respective meanings as viewed from the driver. Incidentally, the drawings are to be looked at according to the posture of symbols.

Figure 1:
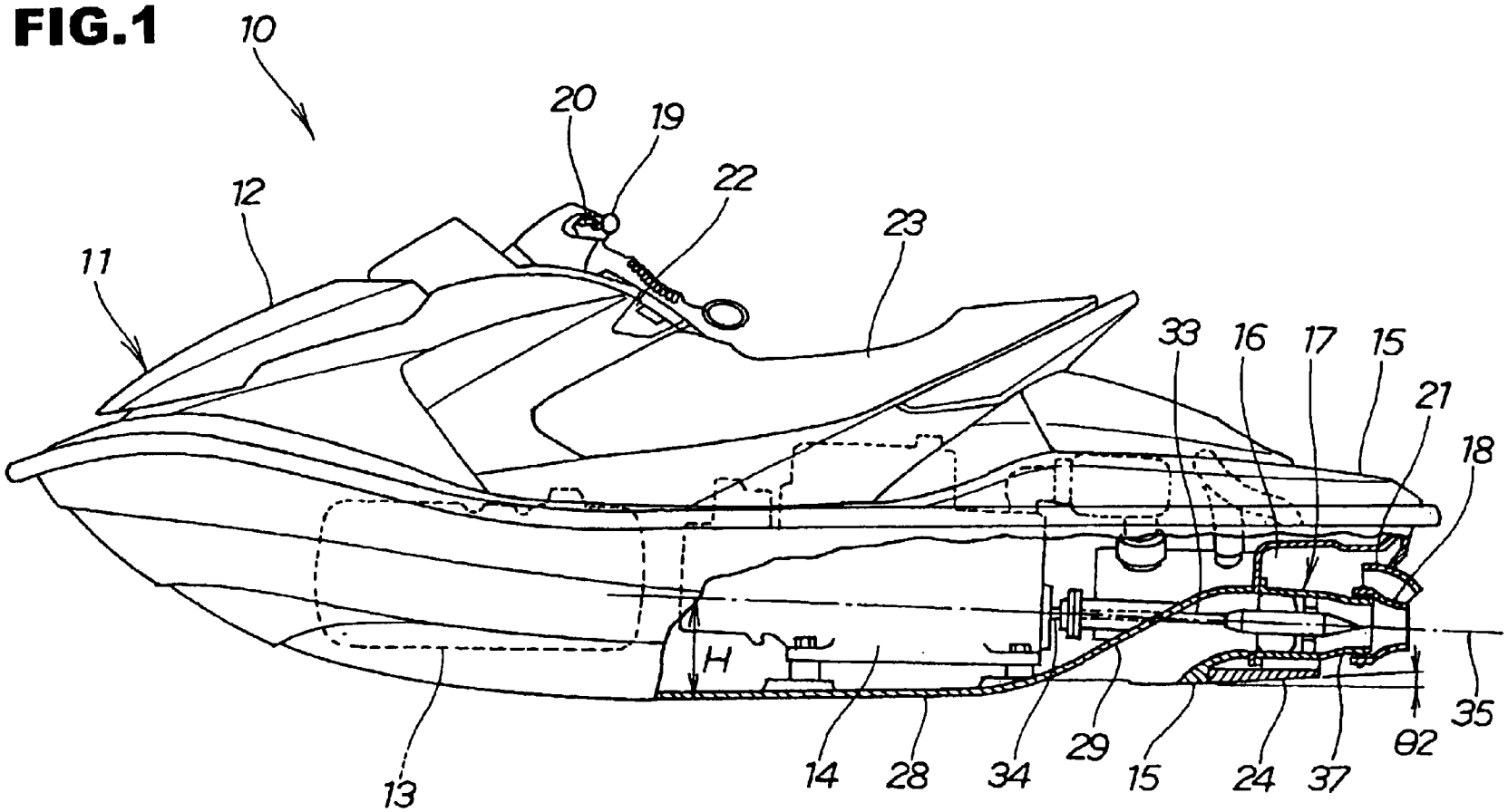
FIG. 1 is a side view of a personal watercraft according to the present invention.

FIG. 1 is a side view of a personal watercraft according to the present invention. The personal watercraft 10 has a structure in which a fuel tank 13 is provided at a front portion 12 of a hull 11, an engine 14 is provided on the rear side of the fuel tank 13, a jet propeller chamber 16 is provided at a stern 15 on the rear side of the engine 14, a water jet propeller (jet propeller) 17 is provided in the jet propeller chamber 16, a steering nozzle 18 is provided on the rear side of the water jet propeller 17, a steering handle 19 for swinging the steering nozzle 18 to the left and right sides is provided on the upper side of the fuel tank 13, a trim operating lever 20 for vertically swinging the steering nozzle 18 is provided on a steering handle 19, a reverse bucket 21 is provided on the rear side of the steering nozzle 18, a reverse operating lever 22 for vertically swinging the reverse bucket 21 is provided on the rear side of the steering handle 19, a seat 23 extending in the front-rear direction is provided on the rear side of the reverse operating lever 22, and a ride plate 24 is provided at the bottom surface of the stem 15 on the rear side of the seat 23.

Figure 2:
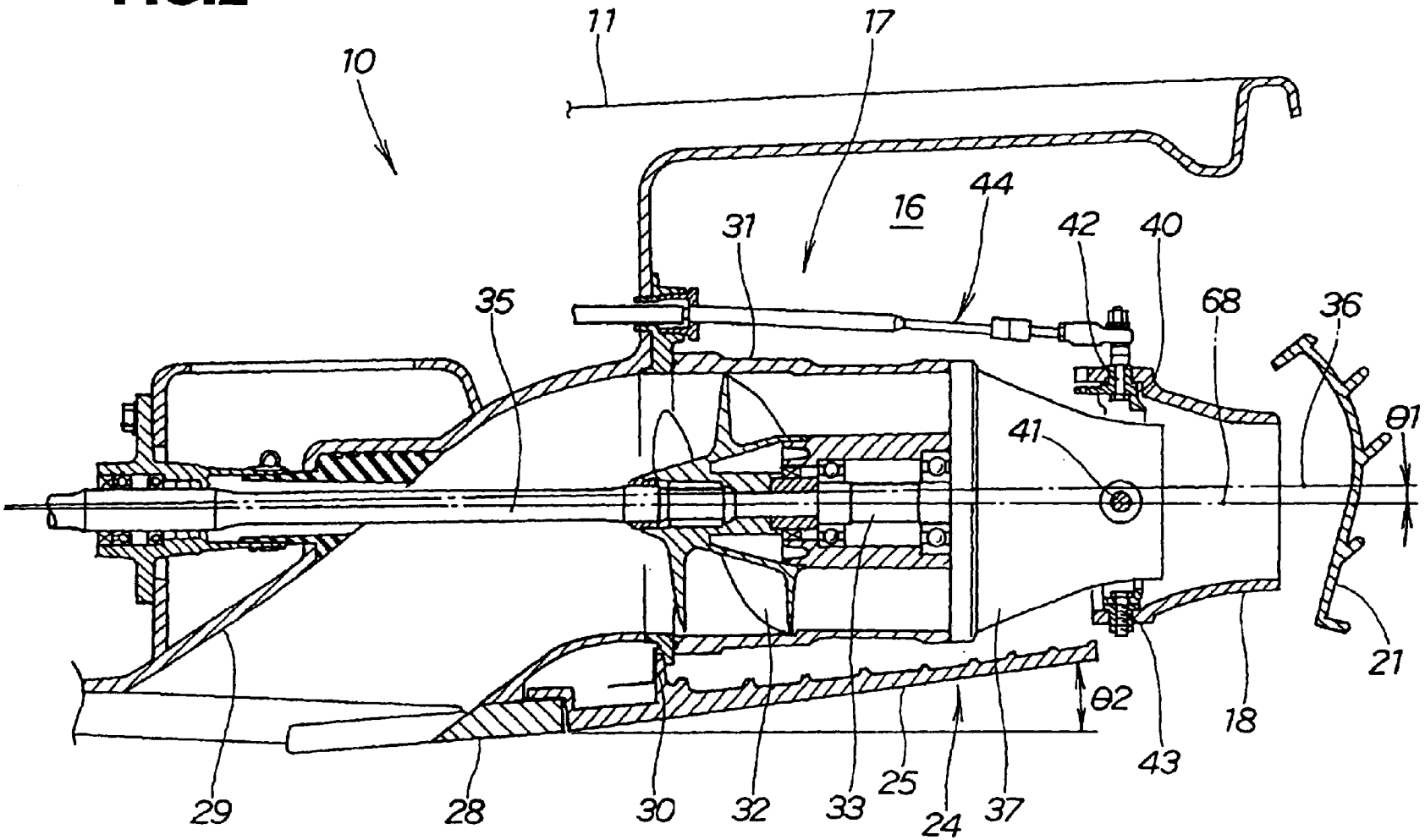
FIG. 2 is a sectional view of a part of the personal watercraft according to the present invention.

FIG. 2 is a sectional view of a part of the personal watercraft according to the present invention, and shows an arrangement where the reverse bucket 21 is disposed at a position on the rear side of the steering nozzle 18, namely, at a reverse position.

The water jet propeller 17 has a structure in which an intake port 29 is provided in the hull bottom 28 of the hull 11, the intake port 29 is extended to the water jet propeller chamber 16, a side wall 30 of the jet propeller chamber 16 is provided with a cylindrical stator 31, an impeller 32 is rotatably disposed in the stator 31, and a drive shaft 34 (see FIG. 1) is connected to the shaft 33 of the impeller 32.

The water jet propeller 17 has its axis 35 (axis of jet nozzle) set with a downward gradient at an angle θ1 (see FIG. 1 also) toward the rear side of the hull 11 relative to a reference line 36 parallel to the horizontal line during planing.

The drive shaft 34 is a shaft for outputting the driving power of the engine 14, with its front end connected to the engine 14.

The impeller 32 can be rotated by rotating the drive shaft 34 by the engine 14 shown in FIG. 1. With the impeller 32 rotated, water can be sucked in through the intake port 29 and led to the stator 31.

The water is then ejected rearwards as jet water from the rear end of the stator 31 and through the steering nozzle 18, whereby the personal watercraft 10 can be made to plane.

Here, the reason why the axis 35 of the water jet propeller 17 is set with the downward gradient at the inclination angle of θ1 toward the rear side of the hull 11 relative to the reference line 36 parallel to the horizontal line during planing will be described.

Referring again to FIG. 1, it is necessary for the water jet propeller 17 to efficiently take in the water sucked in through the intake port 29 and to efficiently eject the water thus taken in as jet water. Therefore, it is preferable that a jet nozzle 37 at a rear portion of the water jet propeller 17 and the steering nozzle 18 mounted onto the jet nozzle 37 are disposed at positions close to the hull bottom 28, namely, at low positions in the hull 11.

On the other hand, the engine 14 must be large enough to provide the output required for driving the water jet propeller 17. Therefore, the crankshaft of the engine 14 (namely, the drive shaft 34 of the engine 14) is disposed at a somewhat high position H from the hull bottom 28.

Therefore, it is necessary to lower the jet nozzle 37 and the steering nozzle 18 to the lower side of the high position H. Accordingly, the axis 35 of the water jet propeller 17 has been set with the downward gradient at the angle θ1 toward the rear side of the hull 11 relative to the reference line 36 parallel to the horizontal line during planing.

Here, by constituting the steering nozzle 18 to be vertically swingable, the axis 68 of the steering nozzle 18 can be made to coincide with the axis 35 of the water jet propeller 17, as shown in FIG. 2.

With this arrangement, jet water can be ejected downwards from the steering nozzle 18. The merits of ejecting the jet water downwards from the steering nozzle 18 will be described in detail later, referring to FIG. 14(*a*).

Figure 4:
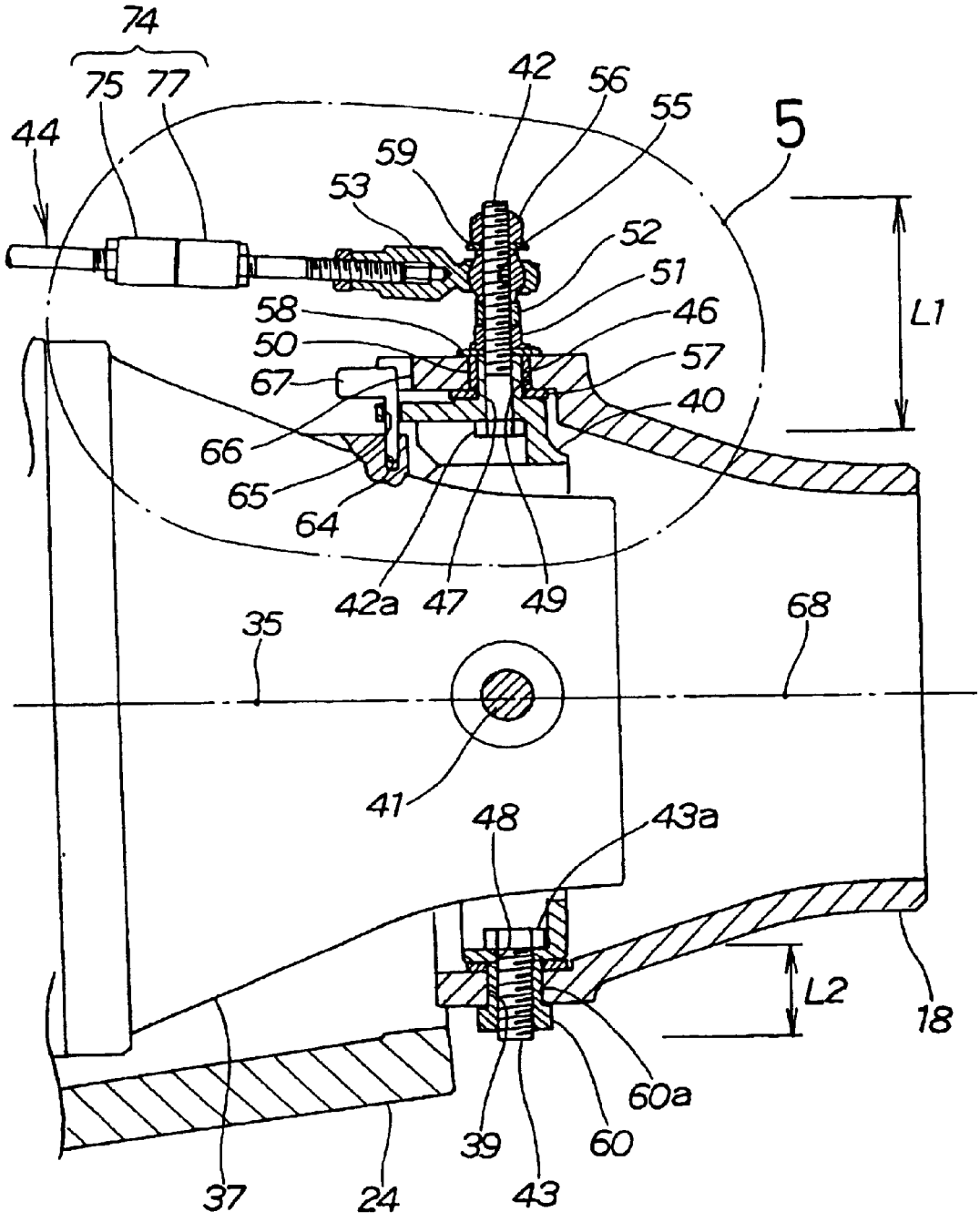
FIG. 4 is an enlarged sectional view of a steering nozzle of the personal watercraft according to the present invention.

Returning to FIG. 2, the water jet propeller 17 has a structure in which a trim ring 40 is mounted onto the jet nozzle 37 at the rear end of the stator 31 with left and right support shafts (bolts) 41, 41 (the bolt on the right side is shown in FIG. 4) so as to be vertically swingable (movable), and the steering nozzle 18 is mounted onto the trim ring 40 with upper and lower support shafts (bolts) 42 and 43 so as to be swingable (movable) in the left-right direction.

A trim operating cable (operating cable) 44 is connected to the steering nozzle 18 through the upper bolt 42, and the trim operating cable 44 is connected to the trim operating lever 20 (see FIG. 4) on the steering handle 19.

With this arrangement, the steering nozzle 18 can be vertically swung, with the left and right bolts 41, 41 as a center, by operating the trim operating cable 44 with the trim operating lever 20.

By vertically moving the steering nozzle 18 in such a manner, the hull 11 can be maintained in a favorable planing posture during planing of the personal watercraft 10.

In addition, the personal watercraft 10 has a structure in which, on the bottom surface of the stern 15, a portion on the lower side of the water jet propeller 17 includes a ride plate 24 which can be detached from the hull 11.

The ride plate 24 is fixed to the hull 11 with bolts (not shown). The bottom surface (the bottom surface of the stern) 25 of the ride plate 24 is set with an upward gradient at an angle θ2 toward the rear side of the hull 11 relative to the reference line 36 parallel to the horizontal line during planing.

The merits of setting the bottom surface 25 of the ride plate 24 with the upward gradient at the angle θ2 toward the rear side of the hull 11 relative to the reference line 36 parallel to the horizontal line during planing will be described in detail later, referring to FIG. 14(*b*).

Figure 3:
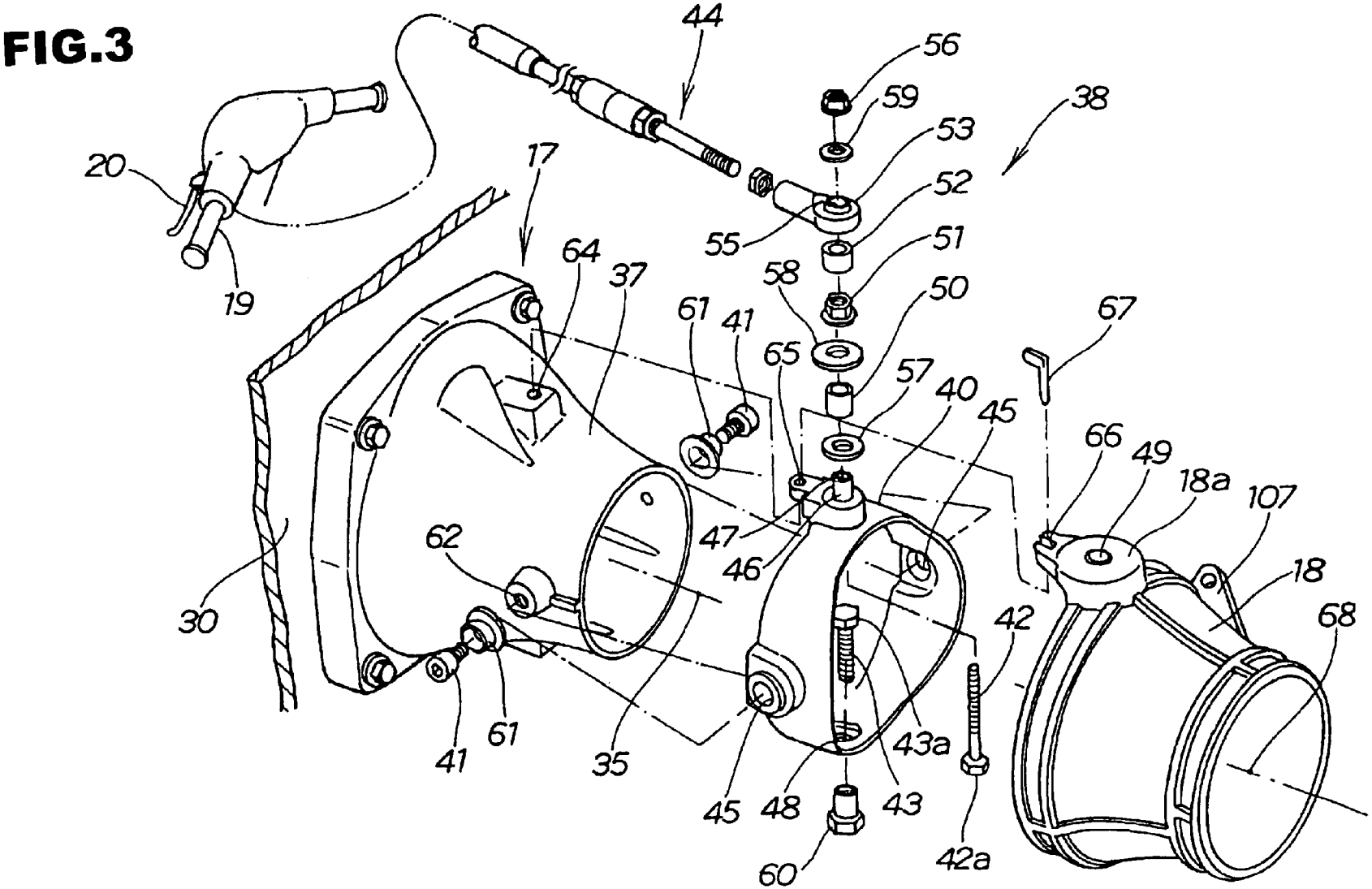
FIG. 3 is an exploded perspective view of a steering nozzle mount structure according to the present invention.

FIG. 3 is an exploded perspective view of another part of the personal watercraft according to the present invention, namely a steering nozzle mount structure.

A steering nozzle mount structure 38 constituting the personal watercraft 10 is a structure in which the trim ring 40 is mounted onto a rear portion of the jet nozzle 37 with the left and right support shafts (bolts) 41, 41 so as to be vertically swingable about the left and right bolts 41, 41, and the steering nozzle 18 is mounted onto the trim ring 40 with the upper and lower support shafts (bolts) 42 and 43 so as to be swingable about the upper and lower bolts 42 and 43, whereby the steering nozzle 18 is mounted onto the jet nozzle 37 so as to be swingable vertically and to the left and right sides.

The trim ring 40 is an annular member. The trim ring 40 is provided with left and right side mount holes 45, 45 respectively in its left and right side portions. The trim ring 40 is provided with a shaft portion 46 at its upper portion. The shaft portion 46 is provided with an upper mount hole 47 penetrating therethrough, and the trim ring 40 is provided with a lower mount hole 48 in its lower portion.

The shaft portion 46 at the upper portion of the trim ring 40 is inserted into an upper mount hole 49 formed in the steering nozzle 18, and a collar 50 is inserted into the space between the upper mount hole 49 and the shaft portion 46. The upper bolt 42 is inserted into the upper mount hole 47 from the inside of the trim ring 40, a nut 51 is fastened to the upper bolt 42 protruding from an upper portion of the steering nozzle 37, and a spacer 52 is fitted over the upper bolt 42 protruding from the nut 51.

A mount hole 55 formed in a trim joint (connection portion) 53 is fitted over the upper bolt 42 protruding from the spacer 52, and a nut 56 is screw-engaged with the upper bolt 42 protruding from the trim joint 53.

A washer 57 is disposed between the trim ring 40 and the steering nozzle 18, and a washer 58 is disposed between the upper end 18*a* of the steering nozzle 18 and the nut 51. Further, a washer 59 is disposed between the trim joint 53 and the nut 56.

In addition, the lower bolt 43 is inserted into the lower mount hole 48 in the trim ring 40 and a lower mount hole 39 (see FIG. 4) in the steering nozzle 18 from the inside, and a nut 60 is screw-engaged with the lower bolt 43 from the outside of the steering nozzle 18.

Therefore, the steering nozzle 18 can be mounted onto the trim ring 40 so as to be swingable in the left-right direction with the upper and lower bolts 42 and 43 as an axis relative to the trim ring 40.

Left and right collars 61, 61 are fitted respectively to the left and right side mount holes 45, 45 in the trim ring 40, the left and right bolts 41, 41 are inserted respectively into the left and right collars 61, 61, and the tip ends of the bolts 41, 41 are screw-engaged with left and right threaded holes 62 (the threaded hole on the right side is not shown) in the jet nozzle 37.

Therefore, the trim ring 40 can be mounted onto the jet nozzle 37 so as to be vertically swingable, with the left and right bolts 41, 41 as an axis relative to the jet nozzle 37.

Thus, the trim ring 40 is mounted onto the jet nozzle 37 so as to be vertically swingable relative to the trim ring 40, and the steering nozzle 18 is mounted onto the trim ring 40 so as to be swingable in the left-right direction relative to the trim ring 40, whereby the steering nozzle 18 can be mounted onto the jet nozzle 37 so as to be swingable vertically and in the left-right direction relative to the jet nozzle 37.

Here, the trim operating cable 44 is connected to the trim joint 53, and the trim operating cable 44 is connected to the trim operating lever 20 on the steering handle 19, whereby the steering nozzle 18 can be vertically swung with the left and right bolts 41, 41 as a center by operating the trim operating cable 44 with the trim operating lever 20.

In addition, the jet nozzle 37 is provided with a recessed portion for positioning (hereinafter referred to as "positioning recessed portion") 64, whereas the trim ring 40 is provided with a through-hole 65 for positioning (hereinafter referred to as "positioning hole"), and the steering nozzle 18 is provided with an insertion groove 66 in its upper end.

A positioning pin 67 is inserted through the insertion groove 66 into the positioning hole 65, and the tip end of the positioning pin 67 protruding from the positioning hole 65 is inserted into the positioning recessed portion 64, whereby the axis 68 of the steering nozzle 18 can be made to coincide with the axis of the jet nozzle 37, namely, the axis 35 of the jet propeller 17.

FIG. 4 is an enlarged sectional view of a steering nozzle of the personal watercraft according to the present invention. The shaft portion 46 at the upper portion of the trim ring 40 is inserted into the upper mount hole 49 in the upper portion of the steering nozzle 18, the collar 50 is inserted into the space between the upper mount hole 49 and the shaft portion 46, the upper bolt 42 is inserted into the upper mount hole 47 in the trim ring 40 from the inside of the trim ring 40, and the nut 51 is screw-engaged with the upper bolt 42 protruding from the upper portion of the steering nozzle 18, whereby the upper bolt 42 is attached to the trim ring 40 and the steering nozzle 18.

After the upper bolt 42 is attached to the trim ring 40 and the steering nozzle 18, the spacer 52 is fitted over the upper bolt 42 protruding from the nut 51 The mount hole 55 in the trim joint 53 is fitted over the upper bolt 42 protruding from the spacer 52, and the nut 56 is screw-engaged with the upper bolt 42 protruding from the trim joint 53.

By this, the upper bolt 42 can be disposed with its head (hereinafter referred to as "upper bolt head") 42*a* directed toward the jet nozzle 37. In addition, the length (upper bolt length) L1 of the upper bolt 42 has been so set that, if the upper bolt 42 is slackened and the upper bolt head 42*a* comes into contact with the jet nozzle 37, the upper bolt 42 will not slip off from the steering nozzle 18, i.e., the upper bolt 42 is maintained fastened to the steering nozzle 18.

Therefore, even if the upper bolt 42 should be slackened, the upper bolt 42 can be prevented from slipping off from the upper mount hole 47, and the upper bolt 42 can be prevented from dropping.

In addition, the lower bolt 43 is inserted into the lower mount hole 48 in the trim ring 40 and the lower mount hole 39 in the steering nozzle 18 from the inside, and the nut 60 is screw-engaged with the lower bolt 43 from the outside of the steering nozzle 18.

A shaft portion 60*a* of the nut 60 can be inserted into the lower mount hole 39 in the steering nozzle 18.

By inserting the lower bolt 43 from the inside of the trim ring 40, the lower bolt 43 can be disposed with its head (hereinafter referred to as "lower bolt head") 43*a* directed toward the jet nozzle 37.

In addition, the length (lower bolt length) L2 of the lower bolt 43 is so set that, if the lower bolt 43 is slackened and the lower bolt head 43*a* comes into contact with the jet nozzle 37, the lower bolt 43 will not slip off from the steering nozzle 18, i.e., the lower bolt 43 is maintained fastened to the steering nozzle 18. Therefore, even if the lower bolt 43 should be slackened, the lower bolt 43 can be prevented from dropping.

Also, since the lower bolt 43 is disposed with the lower bolt head 43*a* on the upper side, the lower bolt 43 can be prevented from dropping, even where the length (lower bolt length) L2 of the lower bolt 43 is not set so that the lower bolt 43 will not slip off from the steering nozzle 18, i.e., the lower bolt 43 is maintained fastened to the steering nozzle 18 when the lower bolt 43 is slackened and the lower holt head 43*a* comes into contact with the jet nozzle 37.

In addition, at the time of mounting the trim ring 40 and the steering nozzle 18 onto the jet nozzle 37, particularly at the time of adjusting the length of the trim operating cable 44, the positioning pin 67 is inserted through the insertion groove 66 into the positioning hole 65, and the tip end of the positioning pin 67 protruding from the positioning pin 65 is inserted into the positioning recessed portion 64.

By this, the axis 68 of the steering nozzle 18 can be made to coincide with the axis of the jet nozzle 37, namely, the axis 35 of the water jet propeller 17. Therefore, the direction of the steering nozzle 18 can be fixed in a standard position.

In this condition, the length of the trim operating cable 44 is adjusted, and after the adjustment of the length of the trim operating cable 44 is completed, the positioning pin 67 is drawn out of the positioning hole 65 and the positioning recessed portion 64.

Figure 5:
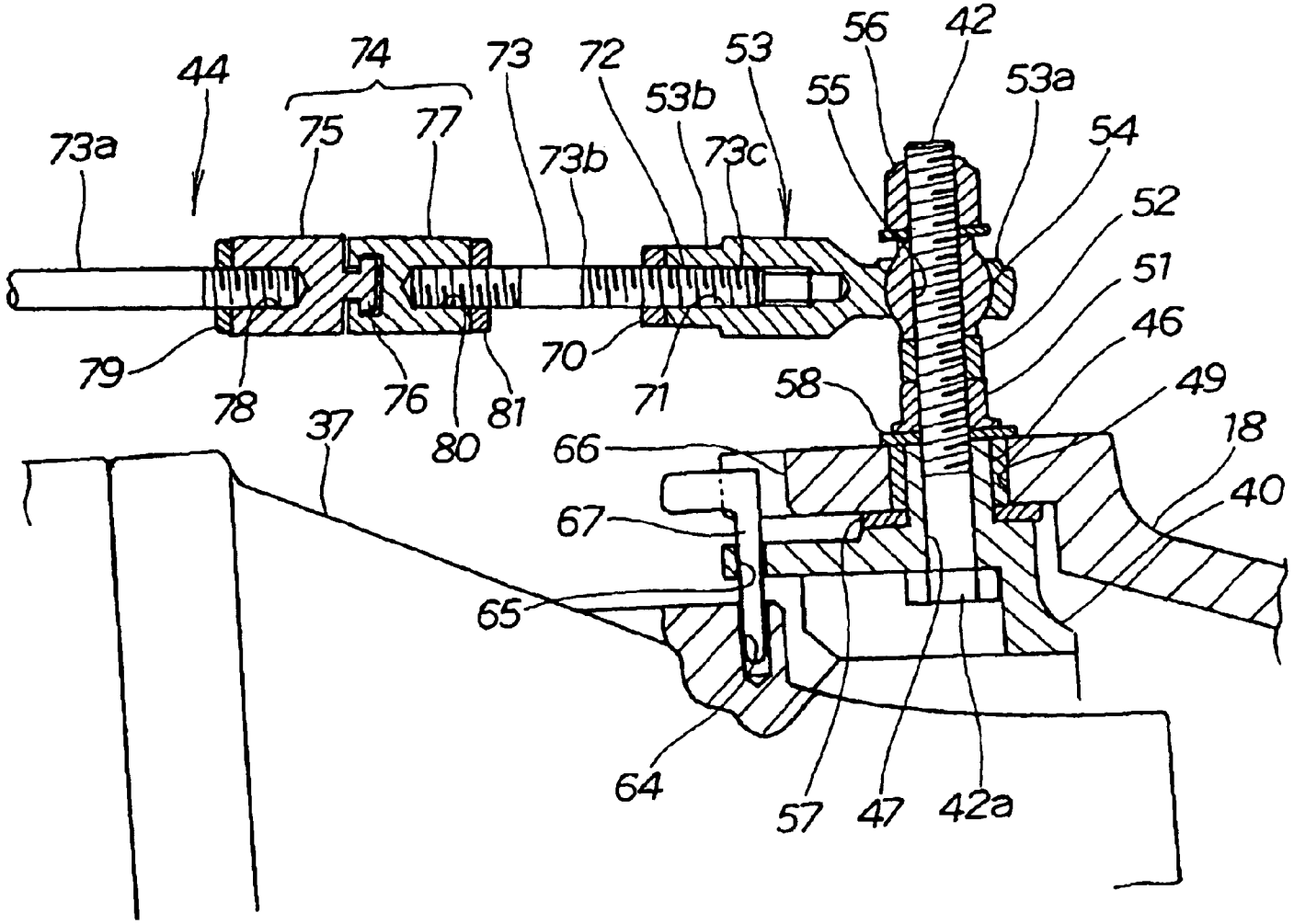
FIG. 5 is an enlarged view of part 5 of FIG. 4.

FIG. 5 is an enlarged view of part 5 of FIG. 4. The upper bolt 42 is inserted into the upper mount hole 47 from the inside of the trim ring 40, the washer 58 is fitted over the upper bolt 42 protruding from the upper portion of the steering nozzle 18, and the nut 51 is fastened from the upper side of the washer 58, whereby the upper bolt 42 can be fixed to the trim ring 40 and the steering nozzle 18.

The trim joint 53 attached to the upper bolt 42 comprises a ball 54 disposed turnably at its head portion 53*a,* and the ball 54 can be mounted onto the upper bolt 42 by fitting a mount hole 55 in the ball 54 over the upper bolt 42. By this, a neck portion 53*b* can be swung in arbitrary directions relative to the ball 54.

A screw portion at the rear end 72 of the trim operating cable 44 is screw-engaged with a threaded hole 71 formed in the neck portion 53*b*. Namely, the trim operating cable 44 comprises a rod portion 73 at its rear end portion, the screw portion formed at the rear end 72 of the rod portion 73 is screw-engaged with the threaded hole 71 in the neck portion 53*b,* and the screw portion is fastened with a lock nut 70. By this, the trim operating cable 44 can be connected to the upper bolt 42. Thus, by connecting the trim operating cable 44 by utilizing the upper bolt 42, the structure can be simplified.

The rod portion 73 is provided with a joint means 74 at its intermediate portion, whereby the rod portion 73 is divided into a front rod 73*a* and a rear rod 73*b*. The joint means 74 has a structure in which a front joint portion 75 is provided at its rear end with a flange 76 with a projection therebetween, and a rear joint portion 77 is rotatably connected to the flange 76.

A rear end screw of the front rod 73*a* is screw-engaged with a threaded hole 78 in the front joint portion 75, the rear end screw is fastened with a lock nut 79, whereas a front end screw of the rear rod 73*b* is screw-engaged with a threaded hole 80 in the rear joint portion 77, and the front end screw is fastened with a lock nut 81. By this, the front and rear rods 73*a* and 73*b* can be connected to each other through the joint means 74.

Since the upper bolt 42 is fixed to the trim ring 40 and the steering nozzle 18 and the trim joint 53 is connected to the upper bolt 42, in the case of readjusting the length of the trim operating cable 44 after once fitting the trim joint 53 over the upper bolt 42, the trim joint 53 is drawn out from the upper bolt 42, the lock nut 70 is slackened, and the connection length between the screw portion 73*c* of the front rod 73*a* constituting the rod 73 and the threaded hole 71 in the neck portion 53*b* is adjusted. By this, the length of the so-called trim operating cable 44 can be adjusted.

Thus, with the constitution in which the trim joint 53 can be fitted over and drawn out from the upper bolt 42 erected on the trim ring 40, the trim operating cable 44 can be tentatively fixed to the upper bolt 42 by simply fitting the trim joint 53 over the upper bolt 42.

By this, in the tentatively fixed condition where the trim joint 53 is only fitted over the upper bolt 42, it is possible to check whether or not the length of the trim operating cable 44 is normal.

Therefore, in the case where it is necessary to readjust the length of the trim operating cable 44, the trim joint 53 can be easily disengaged from the upper bolt 42. Accordingly, the length of the trim operating cable 44 can be easily readjusted by drawing out the trim joint 53 from the upper bolt 42.

In addition, with the joint means 74 intermediately provided at an intermediate portion of the rod portion 73, the trim joint 53 can be rotated arbitrarily. Therefore, when the length of the trim operating cable 44 is adjusted by slackening the lock nut 70 of the trim joint 53 and rotating the trim joint 53 to thereby change the protrusion amount of the trim joint 53, for example, the mount hole 55 in the ball 54 of the trim joint 53 may slip off from the axis of the upper bolt 42.

In this case, by rotating the rear joint portion 77 of the joint means 74, the mount hole 55 in the ball 54 can be adjusted to the axis of the upper bolt 42.

Figure 6:
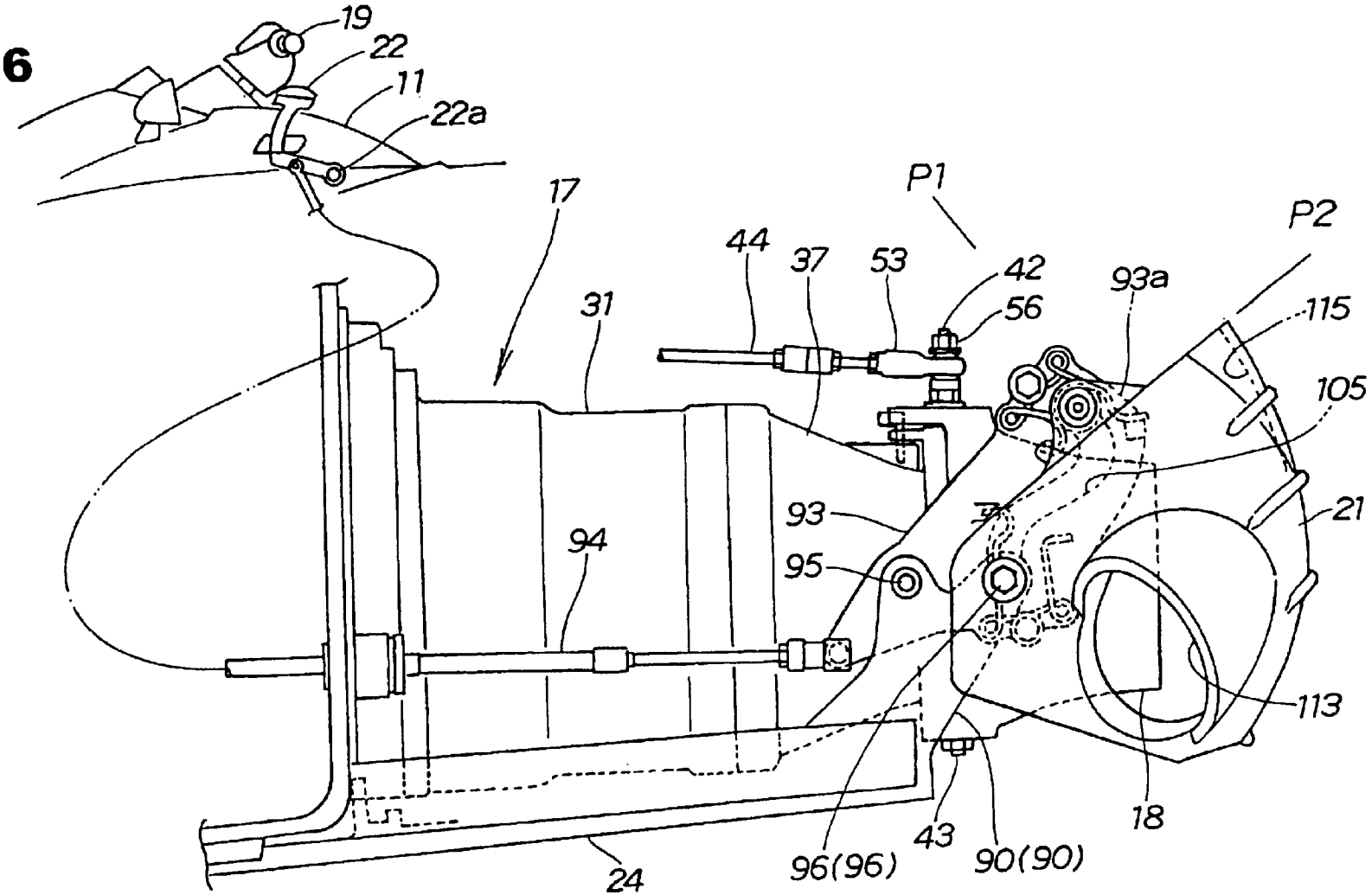
FIG. 6 is a side view showing a reverse bucket and related components of a personal watercraft according to the present invention.

Next, the reverse bucket 21 (see FIGS. 1 and 2) will be described. FIG. 6 is a side view showing a reverse bucket and related components of a personal watercraft according to the present invention.

Left and right support brackets 90 and 91 (for the right support bracket, see also FIG. 7) are provided respectively on the left and right sides of the ride plate 24, and the reverse bucket 21 is mounted onto the left and right support brackets 90 and 91 so as to be vertically swingable.

An intermediate lever 93 is disposed in the gap 92 (see FIG. 7) between the left support bracket 90 and the steering nozzle 18, and the intermediate lever 93 is swingably mounted onto the left support bracket 90. A reverse operating cable 94 is connected to the reverse bucket 21 through the intermediate lever 93, and the reverse operating cable 94 is attached to the reverse operating lever 22.

By vertically swinging the reverse operating lever 22 with a support shaft 22*a* as a center, the reverse operating cable 94 is operated and the intermediate lever 93 is swung with a support shaft 95 as an axis. By swinging the intermediate lever 93, the reverse bucket 21 can be vertically swung, with left and right support bolts 96, 96 (for the right support bolt 96, see also FIG. 7) as an axis.

By this, the reverse bucket 21 can be moved to a forward position P1 on the upper side of the steering nozzle 18 and to a reverse position P2 (the position shown) on the rear side of the steering nozzle 18.

Figure 7:
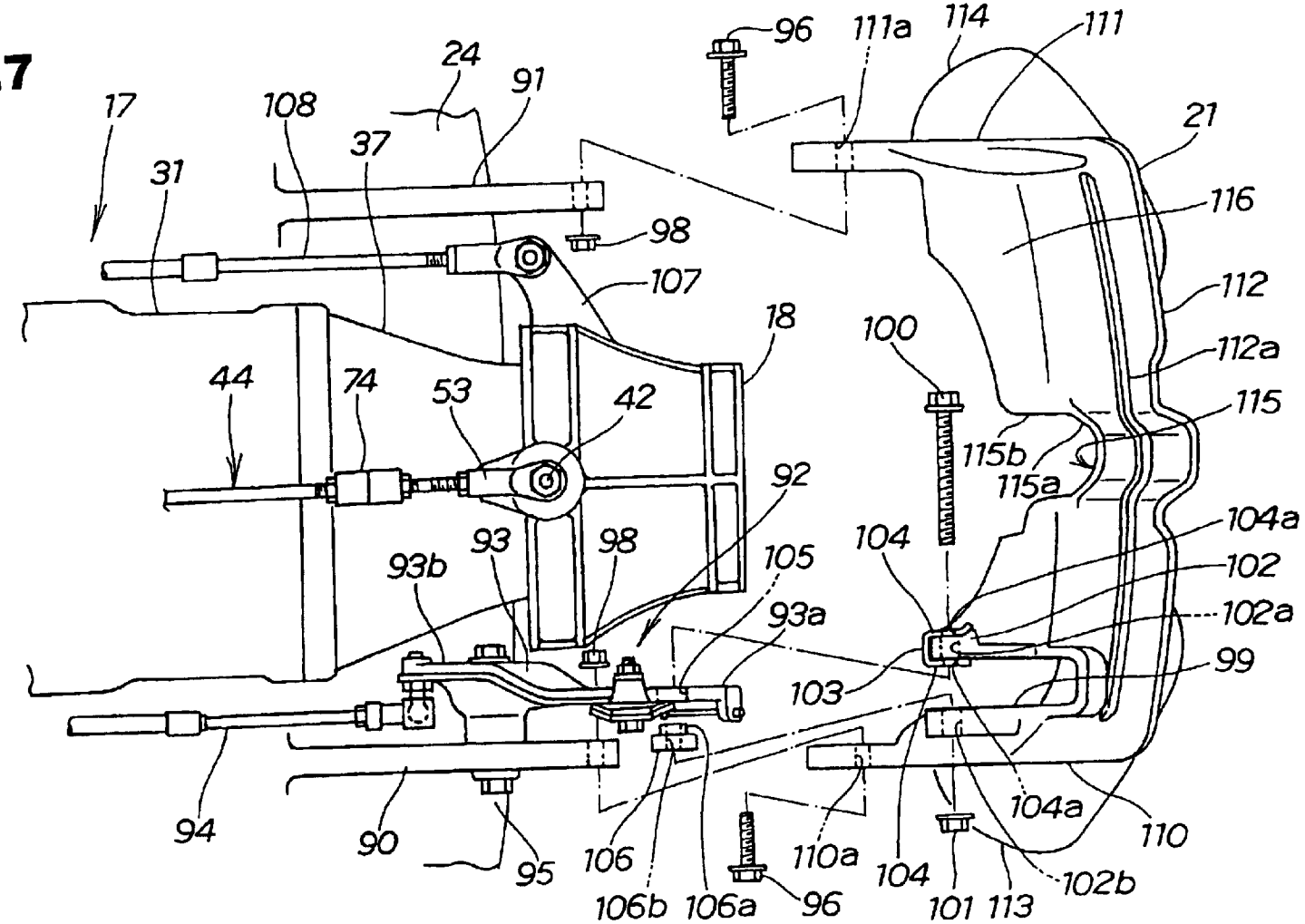
FIG. 7 is a plan view showing the reverse bucket and related components of the personal watercraft according to the present invention.

FIG. 7 is a plan view showing the reverse bucket and related components of the personal watercraft according to the present invention. The left and right support brackets 90 and 91 are provided on the left and right sides of the ride plate 24, namely, on the left and right sides of the steering nozzle 18. The reverse bucket 21 is vertically swingably mounted onto the left and right support brackets 90 and 91 with the left and right support bolts 96, 96 and nuts 98, 98. A containing pocket 99 is provided at a left end portion of the reverse bucket 21, an upper end portion 93*a* of the intermediate lever 93 is inserted into the containing pocket 99, and the intermediate lever 93 thus inserted is attached to the reverse bucket 21 with a mount bolt 100 and a nut 101.

Here, at the time of attaching the upper end portion 93*a* of the intermediate lever 93 to the containing pocket 99 of the reverse bucket 21 with the mount bolt 100 and the nut 101, a washer clip 103 (see FIG. 8 also) is fitted over a boss 102 of the containing pocket 99.

The washer clip 103 is roughly U-shaped, and its two pieces 104, 104 opposed to each other are provided respectively with through-holes 104*a*, 104*a*.

The washer clip 103 is fitted over the boss 102 of the reverse bucket 21, and the through-holes 104*a*, 104*a* in the washer clip 103 are brought into register with a mount hole 102*a* in the boss 102.

A projection 106*a* on a slide member 106 is slidably fitted in a guide groove 105 (see FIG. 6 also) in the intermediate lever 93. A mount hole 106*b* in the slide member 106 is brought into register with the mount holes 102*a* and 102*b* of the containing pocket 99.

The mount bolt 100 is inserted into the mount holes 102*a*, 106*b* and 102*b*, and the nut 101 is screw-engaged with a tip end portion of the mount bolt 100.

The intermediate lever 93 can be attached to the mount holes 102*a* and 102*b* of the containing pocket 99 with the mount bolt 100.

Thus, by fitting the washer clip 103 over the boss 102 of the reverse bucket 21, the need for the ordinary operation of holding a washer by hand at the time of assembly can be eliminated.

Therefore, simplification of the assembling work can be achieved, and the assembly of the intermediate lever 93 into position can be easily carried out in a timesaving manner.

After the intermediate lever 93 is thus disposed between the left support bracket 90 and the steering nozzle 18, the intermediate lever 93 is swingably mounted onto the left support bracket 90 with the support bolt 95.

Then, the reverse operating cable 94 is connected to a lower end portion 93*b* of the intermediate lever 93, whereby the reverse operating cable 94 is disposed along a left side wall of the stator 31.

By operating the reverse operating cable 94 with the reverse operating lever 22 (see FIG. 6), the reverse bucket 21 can be vertically swung with the left and right support bolts 96, 96 as an axis.

The reverse bucket 21 has a structure in which a curved rear wall 112 is connected bridgingly between left and right side walls 110 and 111. The left and right side walls 110 and 111 are provided respectively with left and right jet ports 113 and 114. The left and right side walls 110 and 111 are provided with mount holes 110*a* and 111*a* for mounting onto the left and right support brackets 90 and 91, and the containing pocket 99 is provided with the mount holes 102*a* and 102*b* for mounting the intermediate lever 93 thereon.

Here, the personal watercraft 10 (see FIG. 10) has a structure in which, for vertically swinging the steering nozzle 18 with the left and right bolts 41, 41 (see FIG. 3) as an axis, the upper bolt 42 is attached to an upper end portion of the steering nozzle 18, and the trim operating cable 44 is connected to the upper bolt 42 through the trim joint 53 and disposed along an upper portion of the stator 31.

A roughly central portion of the reverse bucket 21 is located on the rear side of these members, i.e., the upper bolt 42, the trim joint 53 and the trim operating cable 44.

Therefore, at the time of raising the reverse bucket 21 to the forward position P1 (see FIG. 6), a central portion of the rear wall 112 of the reverse bucket 21 may interfere with these members (the upper bolt 42, the trim joint 53 and the trim operating cable 44).

Taking this into account, a connection portion containing recessed portion (recessed portion) 115 for obviating the interference with these members (the upper bolt 42, the trim joint 53 and the trim operating cable 44) is provided in an upper portion 112*a* of the rear wall 112 of the reverse bucket 21.

Figure 8:
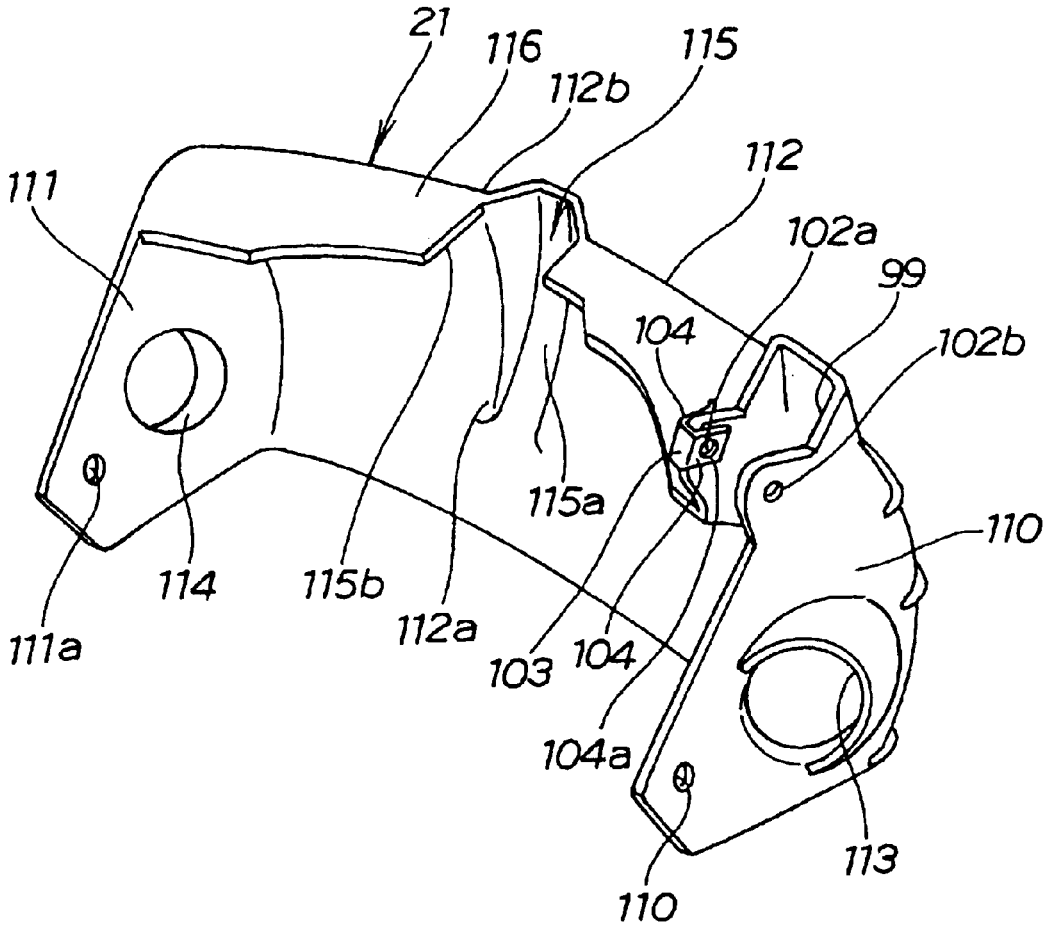
FIG. 8 is a perspective view of a reverse bucket of the personal watercraft according to the present invention.

FIG. 8 is a perspective view of the reverse bucket of the personal watercraft according to the present invention. Referring to FIGS. 7 and 8, the details of the recessed portion 115 will be described.

The connection portion containing recessed portion (recessed portion) 115 comprises a roughly curved containing groove 115*a* bulging rearwards from the rear wall 112 gradually from a central portion 112*a* to the upper end 112*b* of the rear wall 112, and a cutout 115*b* formed in the center of a bent portion 116 of the rear wall 112, namely, at a position corresponding to the containing groove 115*a*.

Thus, the upper bolt 42, the trim joint 53, the trim operating cable 44 and the recessed portion 115 are arranged on the center in the width direction of the hull 11, of the steering nozzle 18. Therefore, it is easy to make the shape of the reverse bucket 21 symmetrical on the left and right sides, so that the personal watercraft 10 (see FIG. 1) can be maintained in such a posture as to be stable in the left-right direction.

Referring to FIG. 7, an arm 107 is extended outwards from the right side wall of the steering nozzle 18, and a steering operating cable 108 is connected to the arm 107 and disposed along the right side wall of the stator 31.

By operating the steering operating cable 108 with the steering handle 19 (see FIG. 1), the steering nozzle 18 can be swung in the left-right direction with the upper and lower bolts 42 and 43 (for the lower bolt 43, see FIG. 4) as an axis.

Referring again to FIG. 8, the recessed portion 115 comprises the containing groove 115*a* formed in the rear wall 112, and comprises the cutout 115*b* formed at the upper end of the containing groove 115*a*, whereby the upper end of the containing groove 115*a* is opened.

The containing groove 115*a* is extended roughly vertically so that the groove depth gradually increases from a rough center 112*a* in the vertical direction of the rear wall 112 toward the upper end 112*b* of the rear wall 112, at the center in the left-right direction of the rear wall 112.

In addition, the cutout 115*b* is formed in the center of the bent portion 116 formed at the upper end of the rear wall 112, namely, at a position corresponding to the containing groove 115*a*.

With the cutout 115*b* thus formed in the center of the bent portion 116, the upper end of the containing groove 115*a* can be opened.

Next, the process of assembling the steering nozzle of the personal watercraft into position will be described based on FIGS. 9 to 12.

Figure 9A:
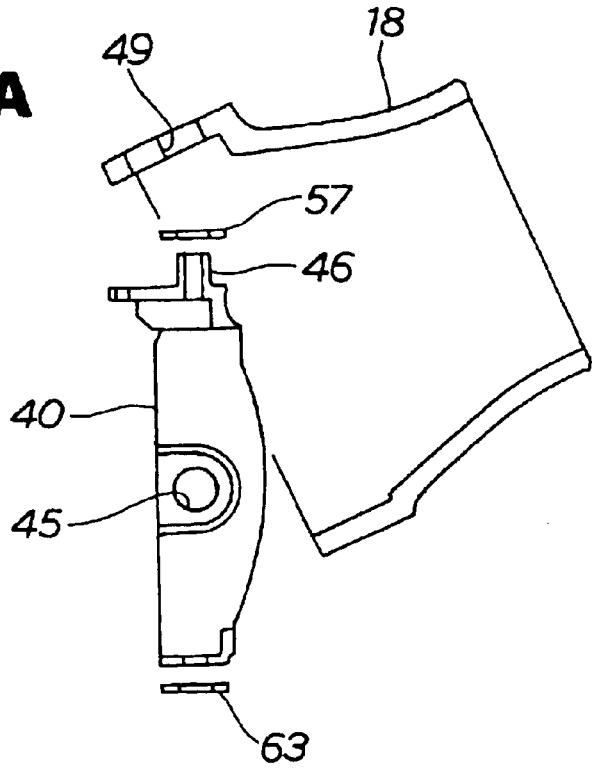
FIGS. 9(*a*) and 9(*b*) are assembly step views for illustrating the process of assembling a steering nozzle onto a jet nozzle, in the personal watercraft according to the present invention.
Figure 9B:
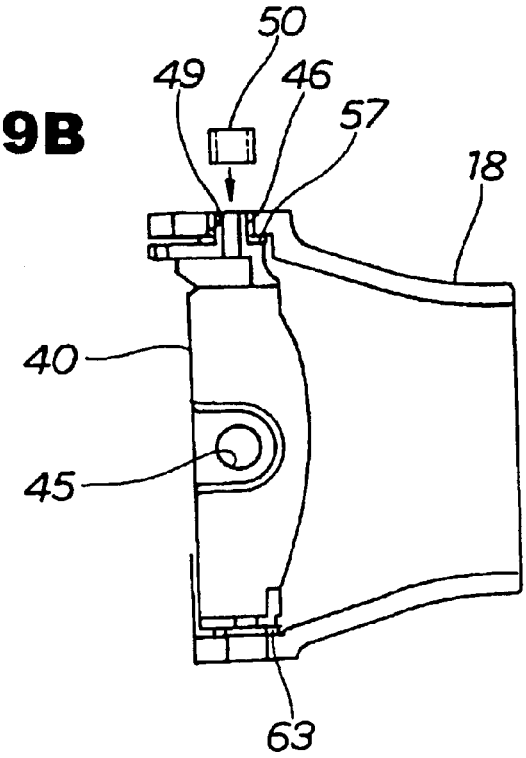

FIGS. 9(*a*) and (*b*) are first assembly step views for illustrating the process of assembling the steering nozzle onto the jet nozzle, in the personal watercraft according to the present invention.

As shown in FIG. 9(*a*), the washer 57 is fitted over the shaft portion 46 at the upper end of the trim ring 40, and a washer 63 is set onto the lower end of the trim ring 40. In this condition, the shaft portion 46 of the trim ring 40 is inserted into the upper mount hole 49 in the steering nozzle 18.

As shown in FIG. 9(*b*), the shaft portion 46 of the trim ring 40 is inserted into the upper mount hole 49 in the steering nozzle 18. Next, the collar 50 is inserted into the gap between the shaft portion 46 of the trim ring 40 and the steering nozzle 18. By this, the trim ring 40 can be contained in the front end of the steering nozzle 18.

Figure 10A:
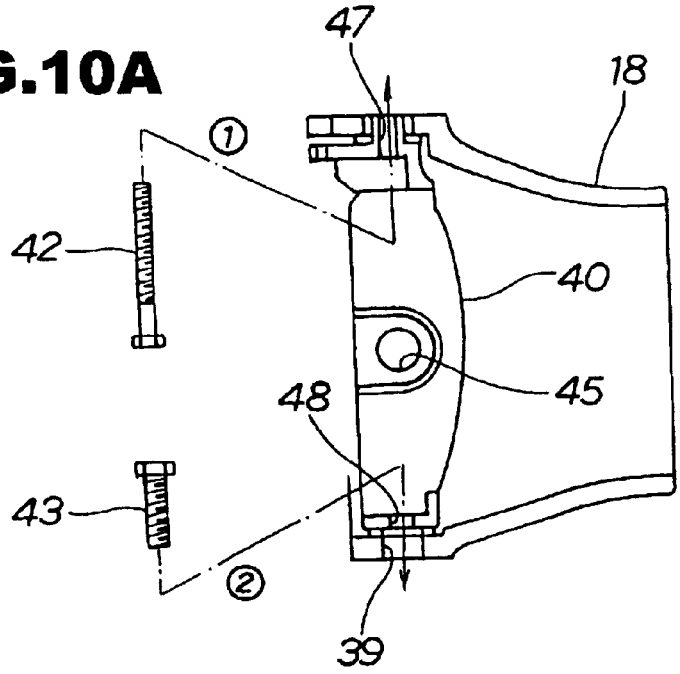
FIGS. 10(*a*) and 10(*b*) are additional assembly step views for illustrating the process of assembling the steering nozzle onto the jet nozzle, in the personal watercraft according to the present invention.
Figure 10B:
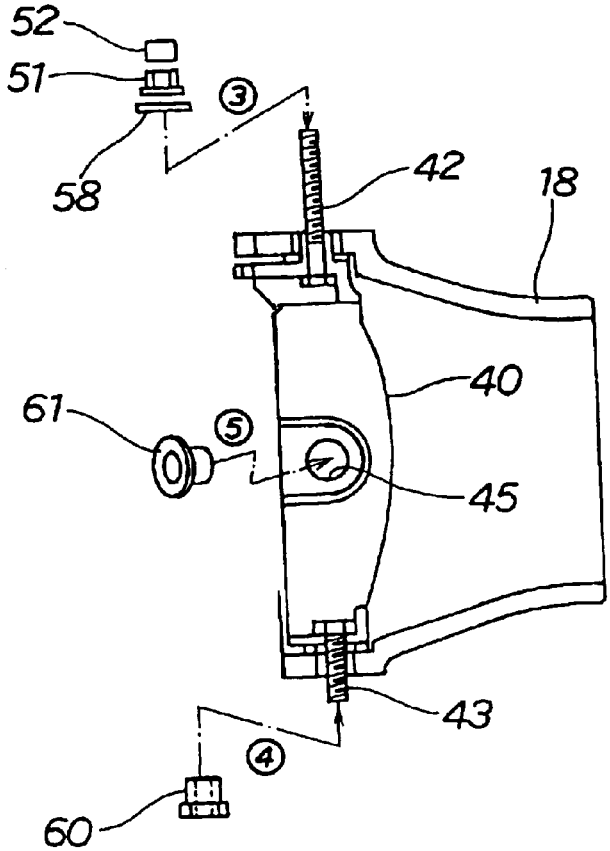

FIGS. 10(*a*) and (*b*) are second assembly step views for illustrating the process of assembling the steering nozzle onto the jet nozzle, in the personal watercraft according to the present invention.

As shown in FIG. 10(*a*), the upper bolt 42 is inserted into the upper mount hole 47 at the upper end of the trim ring 40 from the inside of the trim ring, as indicated by arrow ①. Next, the lower bolt 43 is inserted into the lower mount hole at the lower end of the trim ring and the lower mount hole 39 in the lower portion of the steering nozzle 18 from the inside of the trim ring, as indicated by arrow ②.

As shown in FIG. 10(*b*), the washer 58 is fitted over the upper bolt 42 protruding from the upper end of the steering nozzle 18, as indicated by arrow ③, and the nut 51 is screw-engaged from the upper side thereof. By this, the upper end of the trim ring 40 and the upper end of the steering nozzle 18 are connected to each other through the upper bolt 42.

After the nut 51 is screw-engaged with the upper bolt 42, the spacer 52 is fitted over the upper bolt 42 protruding from the nut.

Next, the nut 60 is screw-engaged with the lower bolt 43 as indicated by arrow ④, whereby the lower end of the trim ring 40 and the lower end of the steering nozzle 18 can be connected to each other through the lower bolt 43.

By this, the trim ring 40 can be connected to the steering nozzle 18 through the upper bolt 42 and the lower bolt 43.

Subsequently, the collars 61, 61 are inserted respectively into the left and right side mount holes 45, 45 (the one on this side is not shown) in the trim ring 40 from the inside of the trim ring 40, as indicated by arrow ⑤.

Figure 11A:
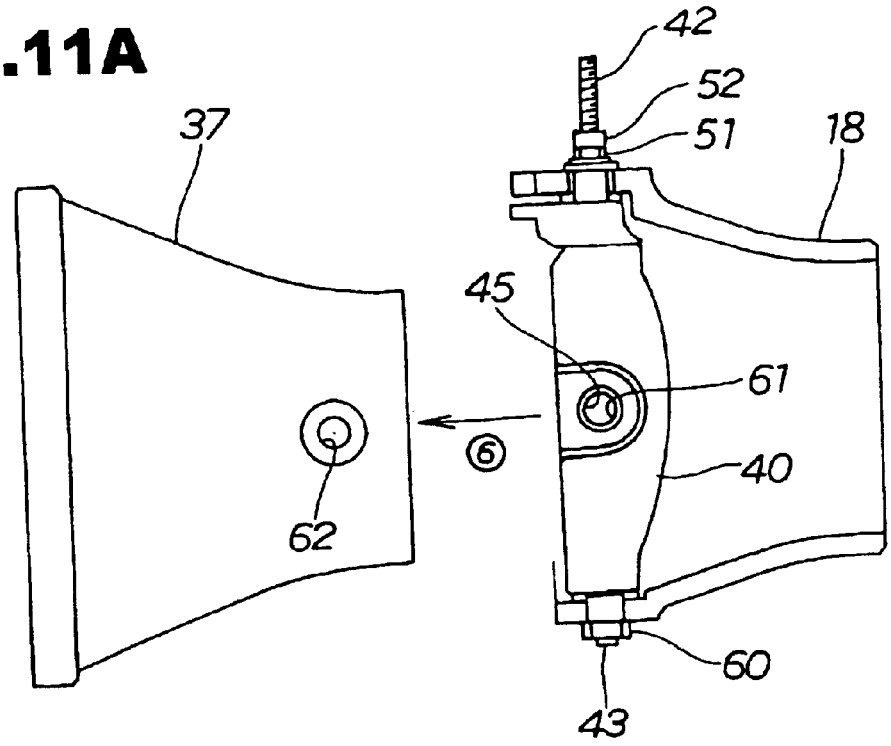
FIGS. 11(*a*) and 11(*b*) are additional assembly step views for illustrating the process of assembling the steering nozzle onto the jet nozzle, in the personal watercraft according to the present invention.
Figure 11B:
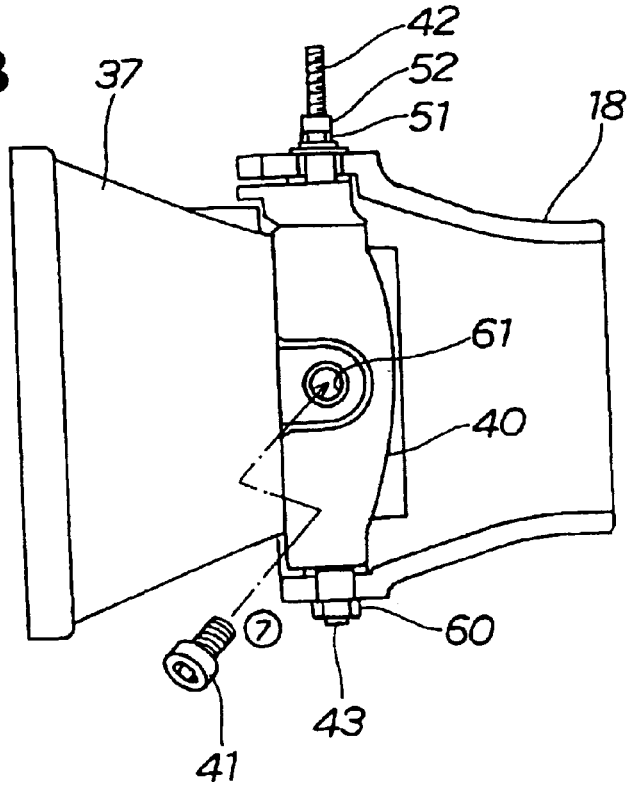

FIGS. 11(*a*) and (*b*) are third assembly step views for illustrating the process of assembling the steering nozzle onto the jet nozzle, in the personal watercraft according to the present invention.

As shown in FIG. 11(*a*), in the condition where the trim ring 40 is connected to the steering nozzle 18 through the upper bolt 42 and the lower bolt 43, the trim ring 40 is set to cover the rear end of the jet nozzle 37 as indicated by arrow ⑥.

As shown in FIG. 11(*b*), the left and right bolts 41, 41 are inserted respectively into the left and right collars 61, 61 as indicated by arrow ⑦.

Figure 12A:
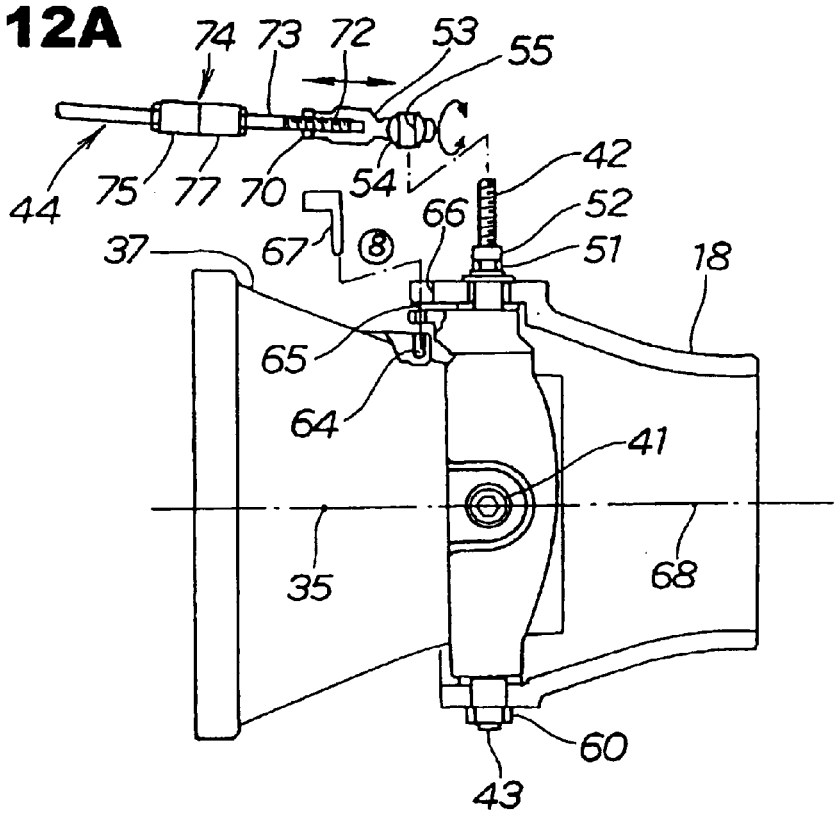
FIGS. 12(*a*) and 12(*b*) are additional assembly step views for illustrating the process of assembling the steering nozzle onto the jet nozzle, in the personal watercraft according to the present invention.
Figure 12B:
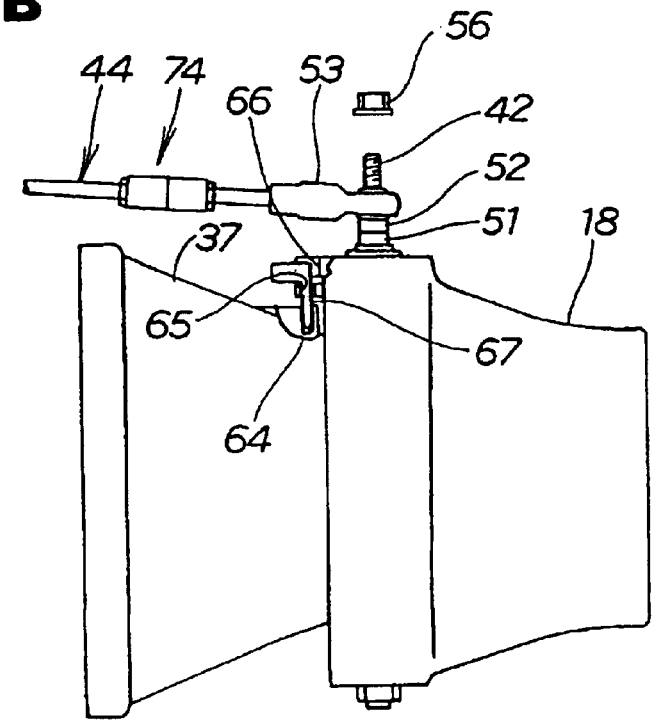

FIGS. 12(*a*) and (*b*) are fourth assembly step views for illustrating the process of assembling the steering nozzle onto the jet nozzle, in the personal watercraft according to the present invention.

As shown in FIG. 12(*a*), the positioning pin 67 is inserted through the insertion groove 66 into the positioning hole 65, and the tip end of the positioning pin 67 protruding from the positioning hole 65 is inserted into the positioning recessed portion 64.

By this, the axis 68 of the steering nozzle 18 can be made to coincide with the axis of the jet nozzle 37, namely, the axis 35 of the water jet propeller 17, and the direction of the steering nozzle 18 can be fixed in the standard position.

Thus, the direction of the steering nozzle 18 can be fixed in the standard position by the simple operation of merely inserting the positioning pin 67 into the positioning hole 65 and the positioning recessed portion 64. Therefore, the direction of the steering nozzle 18 can be adjusted to the normal angle in a laborsaving manner.

After the steering nozzle 18 is fixed in the standard position by inserting the positioning pin 67 into the positioning hole 65 and the positioning recessed portion 64, the trim joint 53 is fitted over the upper bolt 42. In this case, even if the length of the trim operating cable 44 has preliminarily been adjusted, it is necessary to readjust the cable length.

In that case, the trim joint 53 once fitted over the upper bolt 42 is drawn out from the upper bolt 42, and is rotated as indicated by the arrows, thereby adjusting the protrusion amount of the trim joint 53. By this, the length of the trim operating cable 44 can be adjusted.

Here, when the length of the trim operating cable 44 is adjusted by rotating the trim joint 53, for example, the mount hole 55 in the ball 54 of the trim joint 53 may come out of registration with the axis of the upper bolt 42.

In this case, the trim joint 53 can be rotated arbitrarily by the joint means 74 intermediately provided at an intermediate portion of the rod portion 73. Namely, by rotating the rear joint portion 77 of the joint means 74, the mount hole 55 in the ball 54 can be easily brought into register with the axis of the upper bolt 42.

As shown in FIG. 12(*b*), after the length of the trim operating cable 44 is adjusted, the trim joint 53 is fitted over the upper bolt 42. Next, the nut 42 is screw-engaged with the upper bolt 42 protruding upwards from the trim joint 53, thereby to fix the trim joint 53 to the upper bolt 42. By this, the adjustment of the length of the trim operating cable 44 is completed.

Then, after the adjustment of the length of the trim operating cable 44 is completed, the positioning pin 67 is drawn out from the positioning hole 65 and the positioning recessed portion 64, to complete the process of assembling the steering nozzle 18 into position.

Figure 13:
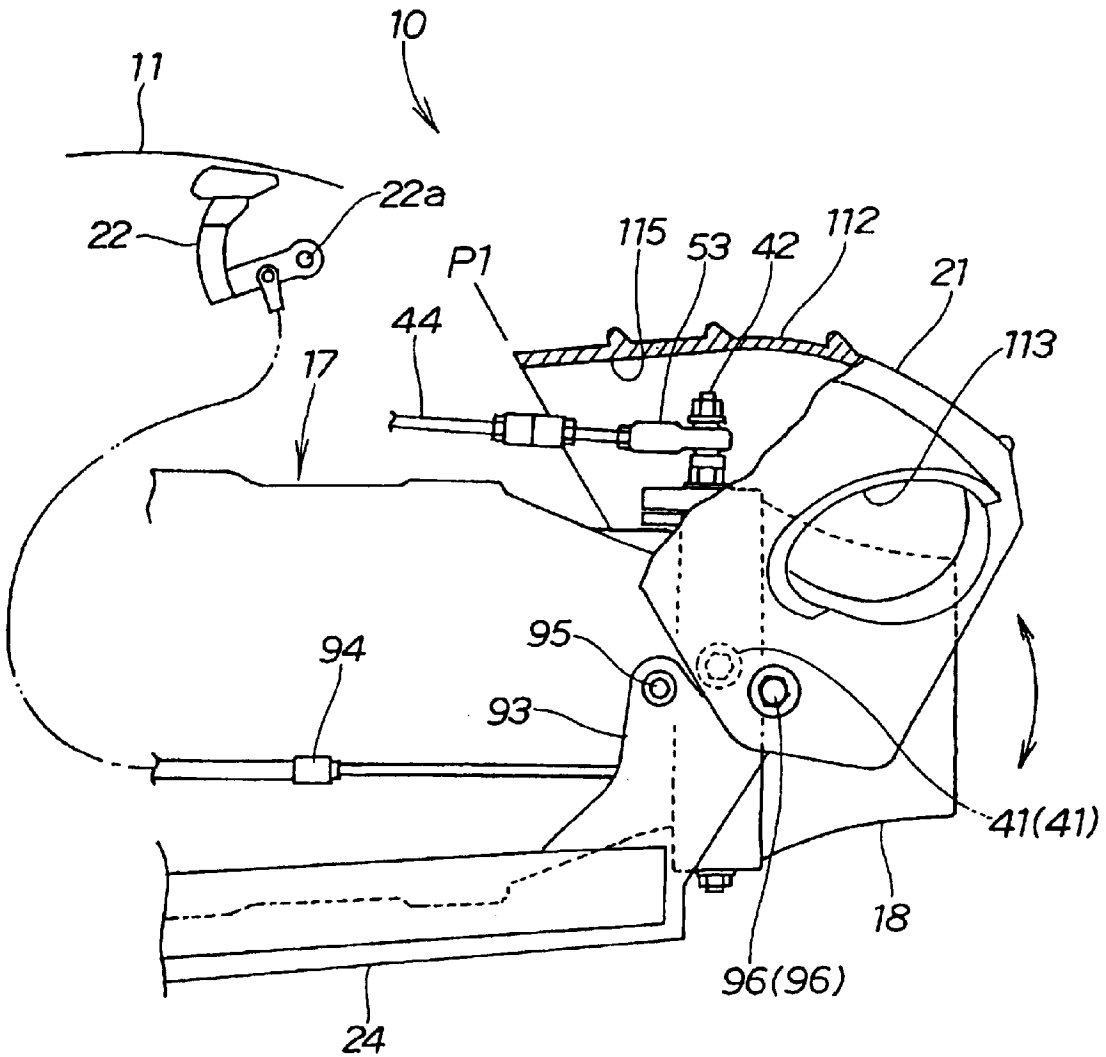
FIG. 13 shows the relationship between an upper bolt and a trim operating cable and the reverse bucket, in the personal watercraft according to the present invention.

FIG. 13 illustrates the relationship between the upper bolt and the trim operating cable and the reverse bucket, in the personal watercraft according to the present invention.

The reverse operating lever 22 is pushed back downwards from the condition shown in FIG. 6, with the support shaft 22*a* as a center. This causes the reverse bucket 21 to be raised from the reverse position P2 to the forward position P1.

Here, the personal watercraft 10 has a constitution in which the steering nozzle 18 is vertically swung as indicated by the arrows, with the left and right bolts 41, 41 as an axis.

For this purpose, the upper bolt 42 is attached to an upper end portion of the steering nozzle 18, and the trim operating cable 44 is connected to the upper bolt 42 through the trim joint 53 and is disposed along an upper portion of the stator 31.

Therefore, at the time of raising the reverse bucket 21 to the forward position P1, the rear wall 112 of the reverse bucket 21 may interfere with these members (the upper bolt 42, the trim joint 53 and the trim operating cable 44).

Taking this into account, as discussed in detail above, the rear wall 112 of the reverse bucket 21 has been provided with the recessed portion 115 for obviating the interference with these members (the upper bolt 42, the trim joint 53 and the trim operating cable 44).

Accordingly, when the reverse bucket 21 is raised to the forward position P1 (as shown in FIG. 13), the rear wall 112 of the reverse bucket 21 can be prevented from interfering with the upper bolt 42 or the trim joint 53.

Figure 14A:
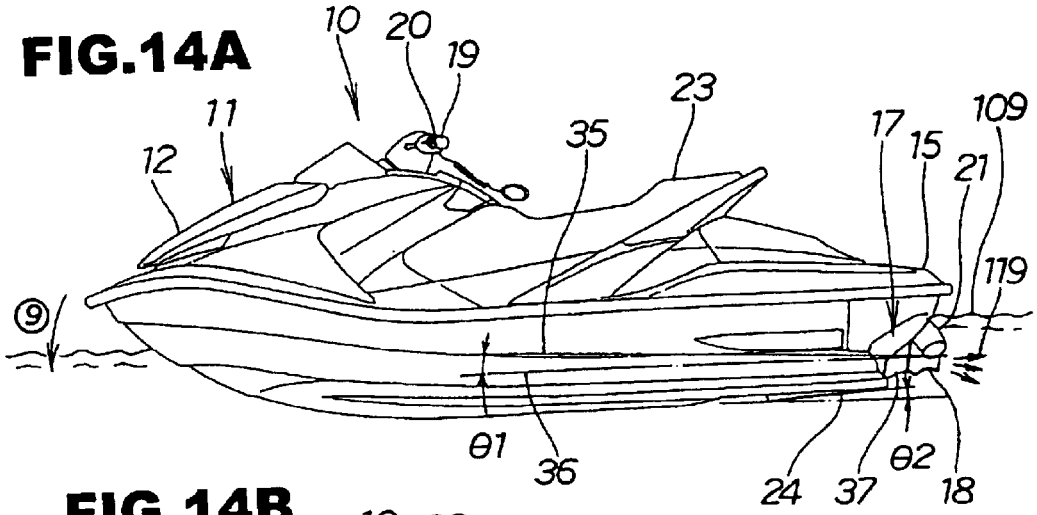
FIGS. 14(*a*), 14(*b*), and 14(*c*) show the propulsion condition of the personal watercraft according to the present invention.
Figure 14B:
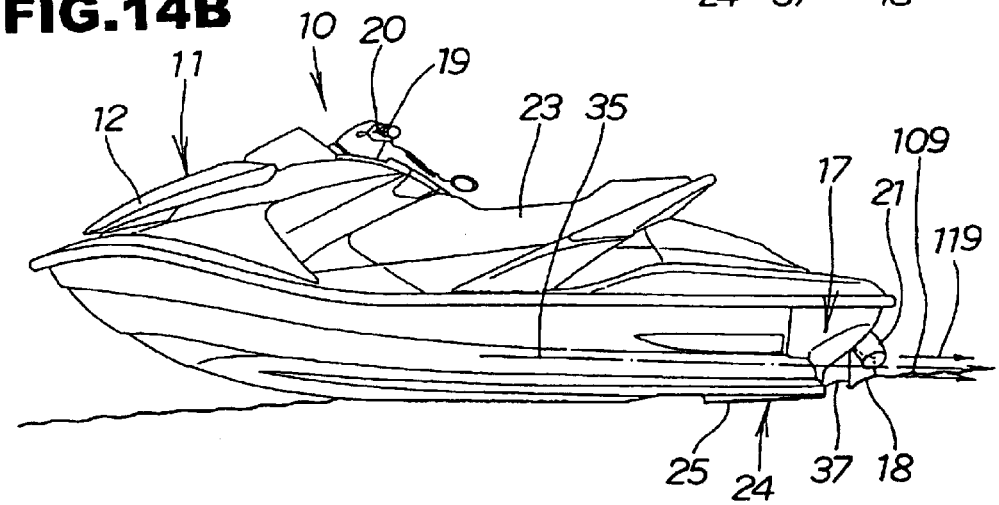
Figure 14C:
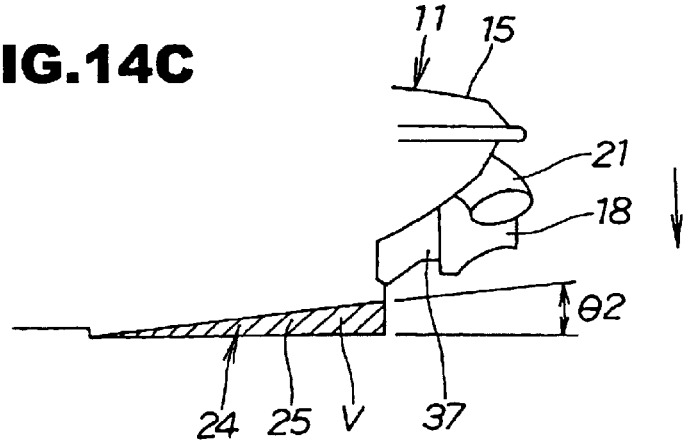

FIGS. 14(*a*) to (*c*) illustrate the propulsion condition of the personal watercraft according to the present invention.

Generally, a personal watercraft has the tendency to cause a front portion 12 of the hull 11 to be floated up (raised up) at the time of starting. Therefore, it is desired to provide a personal watercraft such that the personal watercraft 10 can be favorably started without the floating-up of the front portion 12 (namely, the bow) of the hull 11.

In view of this, the axis 35 of the water jet propeller 17 has been set with the downward gradient at the angle θ1 toward the rear side of the hull 11 relative to the reference line 36 parallel to the horizontal line during planing. By this, the effect as shown in FIG. 14(*a*) is obtained.

In FIG. 14(*a*), at the time of starting the personal watercraft 10, the trim operating lever 20 (see FIG. 1 also) is gripped, whereby the steering nozzle 18 is lowered to a downward posture relative to the axis 35 of the water jet propeller 17. By this, jet water 119 is ejected from the steering nozzle 18 downwards relative to the surface of water 109.

Therefore, a force is exerted that causes the stem 15 of the hull 11 to raise up, which tends to lower the front portion 12 of the hull 11 as indicated by arrow ⑨.

Accordingly, at the time of starting the personal watercraft 10, the personal watercraft 10 can be favorably started without the floating-up of the front portion 12 of the hull 11.

As shown in FIG. 14(*b*), with the jet force of the jet water 119 increased, the personal watercraft 10 is put into a planing condition. When the personal watercraft 10 is planing, the front portion 12 of the hull 11 parts from the surface of water and the tendency toward floating-up is reduced. In view of this, the grip on the trim operating lever 20 (see FIG. 1 also) is released, to set the steering nozzle 18 coaxial with the axis 35 of the water jet propeller 17. By this, the force for floating up the stern 15 of the hull 11 can be reduced.

Here, as shown in FIG. 14(*c*), the personal watercraft 10 has a structure in which the bottom surface 25 of the ride plate 24 is set with an upward gradient at the angle θ2 toward the rear side of the hull 11 relative to the reference line 36 parallel to the horizontal line during planing, as shown in FIG. 14(*a*).

With the bottom surface 25 of the ride plate 24 set with the upward gradient at the angle θ2, a volume (the hatched portion) V can be reduced as compared with an ordinary ride plate. Accordingly, the buoyancy corresponding to the volume V can be reduced.

Therefore, the buoyancy on the stern 15 of the hull 11 can be reduced as compared with the buoyancy on the ordinary hull, so that the stern 15 becomes liable to sink in the direction of the arrow.

Returning to (b), with the personal watercraft 10 put into the planing condition by increasing the jet force of the jet water 119, the velocity of the personal watercraft 10 is increased, and the hull 11 tends to float up from the surface of water 109.

In this case, the steering nozzle 18 coincides with the axis 35 of the water jet propeller 17 and, hence, has the downward gradient at the inclination angle of θ1 relative to the reference line 36 (see FIG. 2). Therefore, a force for lifting up the stern 15 is generated.

Here, with the bottom surface 25 of the ride plate 24 set with the upward gradient at the angle θ2, it is easier to lower the stern 15 downwards. Therefore, the front and rear portions of the hull 11 are favorably floated up from the surface of water 109, and the personal watercraft 10 can plane in a favorable posture.

While an example in which the connection portion containing recessed portion 115 comprises the roughly curved containing groove 115*a* bulging rearwards from the rear wall 112 gradually from the central portion 112*a* toward the upper end 112*b* of the rear wall 112, and the receiving port 115*b* formed at the center of the bent portion 116 of the rear wall 112, namely, at the position corresponding to the containing groove 115, has been described in the above-described embodiment, the connection portion containing recessed portion 115 is not limited to the above-described shape, and various modifications are possible.

The present invention, as described above, displays the following effects. The reverse bucket is provided in its upper portion with the connection portion containing recessed portion for obviating the interference with the connection portion. Therefore, the reverse bucket can be prevented from interfering with the connection portion.

In addition, with the reverse bucket provided with the connection portion containing recessed portion so as to obviate the interference with the connection portion, it is unnecessary to provide the reverse bucket with an opening such as a cutout. Therefore, jet water ejected from the steering nozzle can be favorably received by the reverse bucket, so that the jet water can be efficiently guided forwards.

By this, the steering nozzle can be vertically swung without adversely affecting the functioning of the reverse bucket, and the functions of the personal watercraft can be further enhanced.

Also, the connection portion and the recessed portion are preferably located on the center in the hull width direction of the steering nozzle. Therefore, the shape of the reverse bucket can be easily made symmetrical on the left and right sides, so that the personal watercraft can be favorably maintained in such a posture as to be stable in the left-right direction.

The present invention should not be considered limited to the particular examples or materials described above, but rather should be understood to cover all aspect of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A steering system form personal watercraft comprising:

a steering nozzle that determines the direction of jet water ejected from the watercraft, the steering nozzle being movably disposed on a rear side of the jet propeller, an operating cable for vertically moving the steering nozzle;

a connecting portion of the operating cable being provided at an upper portion of the steering nozzle and connecting the operating cable to the steering nozzle; and a reverse bucket with a recessed portion, the reverse bucket being capable of guiding jet water in a forward direction and being movable between an upper and a lower position, the reverse bucket being disposed on a rear side of the steering nozzle, wherein when the reverse bucket is positioned in the upper position, at least a portion of the connecting portion is positioned inside of the recessed portion.

2. The steering system according to claim 1, wherein the connecting portion and the recessed portion are aligned with a center of the steering nozzle in a hull width direction.

3. The steering system according to claim 1, wherein the recessed portion is a groove formed in the top half of the reverse bucket.

4. The steering system according to claim 1, wherein the reverse bucket further comprises an open section at a top surface of the reverse bucket, the open section being in vertical alignment with the recessed portion.

5. A personal watercraft comprising:

an engine disposed on a lower side of a deck of the watercraft;

a jet propeller disposed on a tear side of the engine;

a steering nozzle for determining the direction of jet water ejected from the watercraft, the steering nozzle being movably disposed on a rear side of the jet propeller;

an operating cable for vertically moving the steering nozzle;

a connecting portion of the operating cable being provided at an upper portion of the steering nozzle and connecting the operating cable to the steering nozzle; and a reverse bucket with a recessed portion, the reverse bucket being capable of guiding jet water in a forward direction and being movable between an upper and a lower position, the reverse bucket being disposed on a rear side of the steering nozzle, wherein when the reverse bucket is positioned in the upper position, at least a portion of the connecting portion is positioned inside of the recessed portion.

6. The personal watercraft according to claim 5, wherein the connecting portion and the recessed portion are aligned with a center of the steering nozzle in a hull width direction of the steering nozzle.

7. The personal watercraft according to claim 5, wherein the recessed portion is a groove formed in the top half of the reverse bucket.

8. The personal watercraft according to claim 5, wherein the reverse bucket further comprises an open section at a top surface of the reverse bucket, the open section being in vertical alignment with the recessed portion.

* * * * *